US011456006B2

(12) United States Patent
Williams et al.

(10) Patent No.: US 11,456,006 B2
(45) Date of Patent: Sep. 27, 2022

(54) SYSTEM AND METHOD FOR DETERMINING AUDIO OUTPUT DEVICE TYPE

(71) Applicant: Apple Inc., Cupertino, CA (US)

(72) Inventors: Joseph M. Williams, Morgan Hill, CA (US); Sean A. Ramprashad, Los Altos, CA (US); Nathan de Vries, San Francisco, CA (US); Nicholas Felton, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/232,027

(22) Filed: Apr. 15, 2021

(65) Prior Publication Data

US 2021/0358515 A1 Nov. 18, 2021

Related U.S. Application Data

(60) Provisional application No. 63/025,026, filed on May 14, 2020.

(51) Int. Cl.

| | |
|---|---|
| ***G10L 25/51*** | (2013.01) |
| ***G10L 21/0232*** | (2013.01) |
| ***H04R 29/00*** | (2006.01) |
| ***G10L 25/06*** | (2013.01) |
| ***H04R 1/08*** | (2006.01) |
| *G10L 21/0208* | (2013.01) |

(52) U.S. Cl.

CPC ..... *G10L 25/51* (2013.01); *G10L 21/0232* (2013.01); *G10L 25/06* (2013.01); *H04R 1/08* (2013.01); *H04R 29/001* (2013.01); *G10L 2021/02082* (2013.01)

(58) Field of Classification Search

None

See application file for complete search history.

(56) References Cited

U.S. PATENT DOCUMENTS

| | | | | |
|---|---|---|---|---|
| 9,860,641 | B2 * | 1/2018 | Kyriakakis | H04R 3/04 |
| 10,405,114 | B2 * | 9/2019 | Stone | G10L 25/51 |
| 10,455,073 | B2 * | 10/2019 | Lee | H04M 19/04 |
| 2001/0049566 | A1 * | 12/2001 | Kim | H03G 3/3089 700/94 |
| 2013/0259241 | A1 * | 10/2013 | Schul | H04R 1/1041 381/56 |
| 2014/0160362 | A1 * | 6/2014 | Shintani | H04N 21/439 348/738 |

(Continued)

OTHER PUBLICATIONS

First Examination Report of the Indian Patent Office dated Feb. 28, 2022 for related Indian Application No. 202114021345.

*Primary Examiner* — Paul W Huber

(74) *Attorney, Agent, or Firm* — Womble Bond Dickinson (US) LLP

(57) ABSTRACT

A method performed by a processor of an audio source device. The method drives an audio output device of the audio source device to output a sound with an audio output signal. The method obtains a microphone signal from a microphone of the audio source device, the microphone signal capturing the outputted sound. The method determines whether the audio output device is a headset or a loudspeaker based on the microphone signal and configures an acoustic dosimetry process based on the determination.

21 Claims, 3 Drawing Sheets

(56) References Cited

U.S. PATENT DOCUMENTS

| | | | | |
|---|---|---|---|---|
| 2015/0063587 | A1* | 3/2015 | Park | H04R 1/1016 381/74 |
| 2015/0256926 | A1* | 9/2015 | Kim | H04R 3/12 381/77 |
| 2016/0286299 | A1* | 9/2016 | Anderson | H04R 25/606 |
| 2018/0359555 | A1* | 12/2018 | Jenkins | G01H 3/12 |
| 2021/0073005 | A1* | 3/2021 | Xi | G06F 9/4418 |

* cited by examiner

SYSTEM AND METHOD FOR DETERMINING AUDIO OUTPUT DEVICE TYPE

CROSS-REFERENCE TO RELATED APPLICATION

This application claims the benefit of and priority of U.S. Provisional Patent Application Ser. No. 63/025,026, filed May 14, 2020, which is hereby incorporated by this reference in its entirety.

FIELD

An aspect of the disclosure relates to configuring an audio source device based on a determination of whether an audio output device is a headset or a loudspeaker. Other aspects are also described.

BACKGROUND

Headphones are an audio device that includes a pair of speakers, each of which is placed on top of a user's ear when the headphones are worn on or around the user's head. Similar to headphones, earphones (or in-ear headphones) are two separate audio devices, each having a speaker that is inserted into the user's ear. Both headphones and earphones are normally wired to a separate playback device, such as an MP3 player, that drives each of the speakers of the devices with an audio signal in order to produce sound (e.g., music). Headphones and earphones provide a convenient method by which the user can individually listen to audio content without having to broadcast the audio content to others who are nearby.

SUMMARY

An aspect of the disclosure is a method performed by an audio source device, such as a multimedia device, that includes a microphone. The audio source device transmits an audio output signal, which may contain user-desired audio content such as music, to an audio output device for driving a speaker to output a sound. For instance, the source device may transmit the signal via a wired or wireless connection with the output device. The source device obtains a microphone signal from the microphone of the source device, where the microphone signal captures the outputted sound by the output device's speaker. The source device determines whether the output device is a headset (e.g., earphones) or a loudspeaker, and configures an acoustic dosimetry process based on the determination.

In one aspect, the determination may be based on how much of the outputted sound is contained within the microphone signal. For instance, the source device may process the microphone signal by performing an acoustic echo cancellation process upon the microphone signal using the audio output signal as a reference input, to produce a linear echo estimate, which corresponds to the amount of output signal that is contained within the microphone signal. The source device determines a level of correlation between the audio output signal and the linear echo estimate. In some aspects, when the level of correlation is above a threshold the output device is determined to be the loudspeaker, and when the level of correlation is below the threshold the output device is determined to be the headset.

The above summary does not include an exhaustive list of all aspects of the disclosure. It is contemplated that the disclosure includes all systems and methods that can be practiced from all suitable combinations of the various aspects summarized above, as well as those disclosed in the Detailed Description below and particularly pointed out in the claims. Such combinations may have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect of this disclosure are not necessarily to the same aspect, and they mean at least one. Also, in the interest of conciseness and reducing the total number of figures, a given figure may be used to illustrate the features of more than one aspect, and not all elements in the figure may be required for a given aspect.

DETAILED DESCRIPTION

Figure 1A:
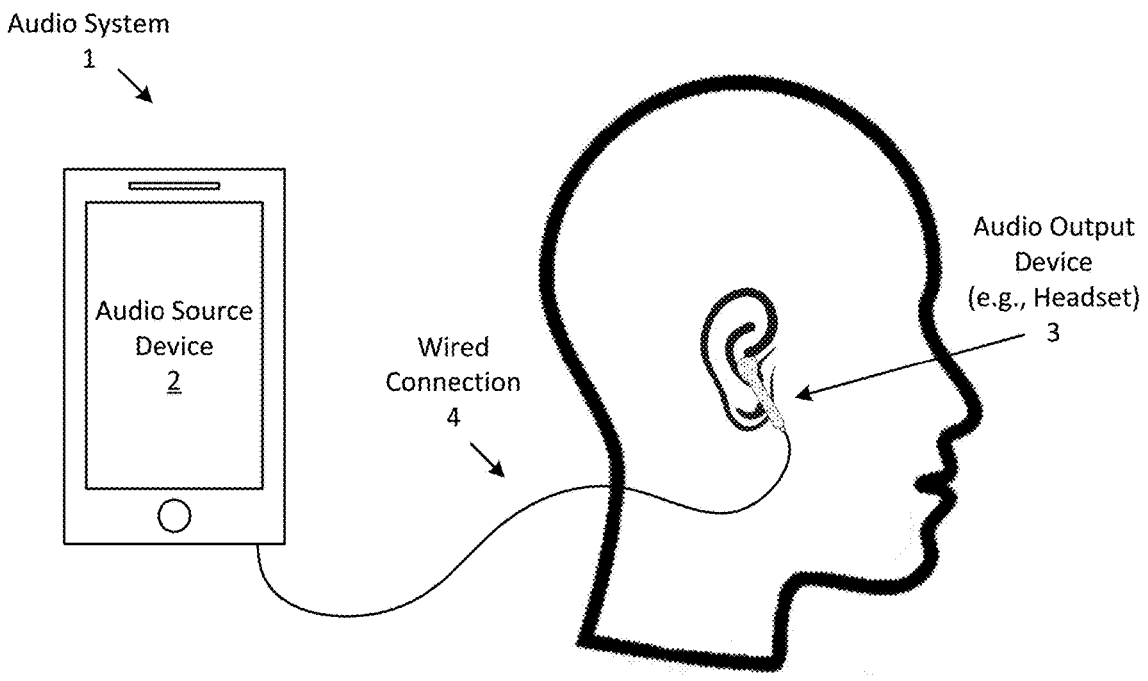
FIG. 1A shows the audio system that includes the audio source device and an audio output device.

Several aspects of the disclosure with reference to the appended drawings are now explained. Whenever the shapes, relative positions and other aspects of the parts described in a given aspect are not explicitly defined, the scope of the disclosure here is not limited only to the parts shown, which are meant merely for the purpose of illustration. Also, while numerous details are set forth, it is understood that some aspects may be practiced without these details. In other instances, well-known circuits, structures, and techniques have not been shown in detail so as not to obscure the understanding of this description. Furthermore, unless the meaning is clearly to the contrary, all ranges set forth herein are deemed to be inclusive of each range's endpoints.

Acoustic dosimetry may be a process of the measuring audio exposure over a period of time (e.g., an hour, a day, a week, a month, etc.) in order to provide a cumulative audio-exposure reading (e.g., a sound pressure level (SPL) value). For instance, a listener may be exposed to user-desired audio content (e.g., music) through an audio output device, such as a headset that is worn by a listener. Acoustic dosimetry may also relate to measuring a listener's exposure to environmental noise. To measure environmental noises, an electronic device (e.g., a SPL meter) captures the noises (e.g., using a microphone) that are within a close proximity to a listener, and outputs a SPL reading (e.g., displaying the reading on a display screen of the SPL meter).

Extended periods of exposure to loud sounds have been shown to cause hearing loss (e.g., noise-induced hearing loss (NIHL)). NIHL is attributed to damage to microscopic hair cells inside the inner ear due to loud sound exposure. For instance, extended exposure to sounds at or above 85 dB may cause temporary or permanent hearing loss in one or both ears. Therefore, some organizations (e.g., the National Institute for Occupational Safety and health (NIOSH) has recommended that worker exposure to ambient noise be controlled below a level equivalent to 85 dBA for eight hours to minimize occupational NIHL.

Electronic headsets have become increasingly popular with users, because they reproduce media such as music, podcasts, and movie sound tracks with high fidelity while at the same time not disturbing others who are nearby. Recently, the World Health Organization (WHO) has released hearing health safety standards that limit the maximum sound output of a headset to 85 dBA. In order to satisfy this standard, an acoustic dosimetry process (e.g., that is executed within the headset or another electronic device that is paired with the headset) may monitor an in-ear SPL at the headset, and notify (or alert) a user when the sound exceeds that threshold. Specifically, the acoustic dosimetry process measures or estimates in-ear SPL, e.g., at or near an eardrum reference point, during sound playback. In one aspect, the in-ear SPL is measured as follows. The signal from an internal microphone of the headset, which picks up all sounds in the ear canal, may be processed into an equivalent SPL, using for example laboratory calibration results that include correction factors, e.g., equalization, to be applied to the microphone signal. These correction factors may account for an occlusion effect in which the headsets at least partially occlude the user's ear canal. The in-ear SPL may be determined during playback through the headset worn by the user. Once estimated, the in-ear SPL is converted into a sound sample having units defined by the hearing health safety standards, as described herein. These sound samples may then be used by the dosimetry process to track headset audio exposures. This conversion of the in-ear SPL into sound samples may be unnecessary, however, when the sound is being played back into the ambient environment, e.g., by a loudspeaker. Therefore, it may be necessary to determine the type of audio output device through which a listener is listening to sound in order to properly configure a dosimetry process (e.g., to convert in-ear SPL values when the output device is a headset).

To overcome these deficiencies, the present disclosure describes an audio system that is capable of configuring a dosimetry process based upon a determination of whether the listener is listening to sound through a headset or a loudspeaker. Specifically, the audio system may include an audio source device that is transmitting an audio output signal to an audio output device for driving a speaker to output a sound. A microphone signal is obtained from a microphone in the audio source device, which captures the outputted sound. The audio system determines whether the audio output device is a headset or a loudspeaker based on the microphone signal. Based on the determination, an acoustic dosimetry process is configured. For instance, upon determining that the audio output device is a headset, the process is configured to make sound level measurements associated with headset use. In contrast, upon determining that the audio output device is a loudspeaker, the process is configured to make sound level measurement associated with ambient noise. Thus, the audio system is able to provide accurate sound level measurements and notifications based on the type of sound output device that is outputting the sound.

FIG. 1A illustrates an audio system 1 that includes an audio source device 2 and an audio output device 3 that is being worn by a user (or wearer). In one aspect, the audio system may include other devices, such as a remote electronic server (not shown) that may be communicatively coupled to either the headset or the audio source device, and is configured to perform one or more operations as described herein. As illustrated, the output device is a headset that is an electronic device that is designed to be worn on a user's head and is arranged to direct sound into the ears of the wearer. Specifically, as illustrated in this figure, the headset is a pair of earphones (in-ear headphones or earbuds), where only the right earphone is shown to be positioned on the user's right ear. In one aspect, the headset may include two earphones (one left and one right) or may include one earphone. In some aspects, the earphones may be a sealing type earphone that has a flexible ear tip that serves to acoustically seal off the entrance of the user's ear canal from the ambient environment by blocking or occluding in the ear canal. In another aspect, the headset may be an over-the-ear headset (or headphone) that at least partially covers a respective ear of the user. In some aspect, the output device is an on-the-ear headphone. In another aspect, the output device may be any electronic device that includes at least one speaker and is arranged to be worn by the user and arranged to output sound.

The audio source device 2 is a multimedia device, more specifically a smart phone. In one aspect, the audio source device may be any electronic device that can perform audio signal processing operations and/or networking operations. An example of such a device may be a tablet computer, a laptop, a desktop computer, a smart speaker, etc. In one aspect, the source device may be a portable device, such as a smart phone as illustrated in this figure. In another aspect, the source device may be a head-mounted device, such as smart glasses, or a wearable device, such as a smart watch.

As shown, the audio source device 2 is communicatively coupled to the audio output device 3, via a wired connection 4. Specifically, the wired connection may be one or more wires that are fixedly coupled (or integrated with) the audio output device, and are removably coupled to the source device. In one aspect, the wired connection may be removably coupled to each of the devices. In another aspect, the wired connection may be an analog wired connection via a connector, such as a media 3.5 mm jack, which plugs into a socket of the audio source device. Once connected, the audio source device may be configured to drive the speakers of the output device with one or more audio output signals in order for the output device to playback sound. In this case, the audio output signals may be analog audio signals transmitted to the output device (via the wired connection 4). In another aspect, the wired connection may be a digital connection via a connector, such as a universal serial bus (USB) connector in which one or more audio signals are digitally transmitted to the audio output device for playback.

Figure 1B:
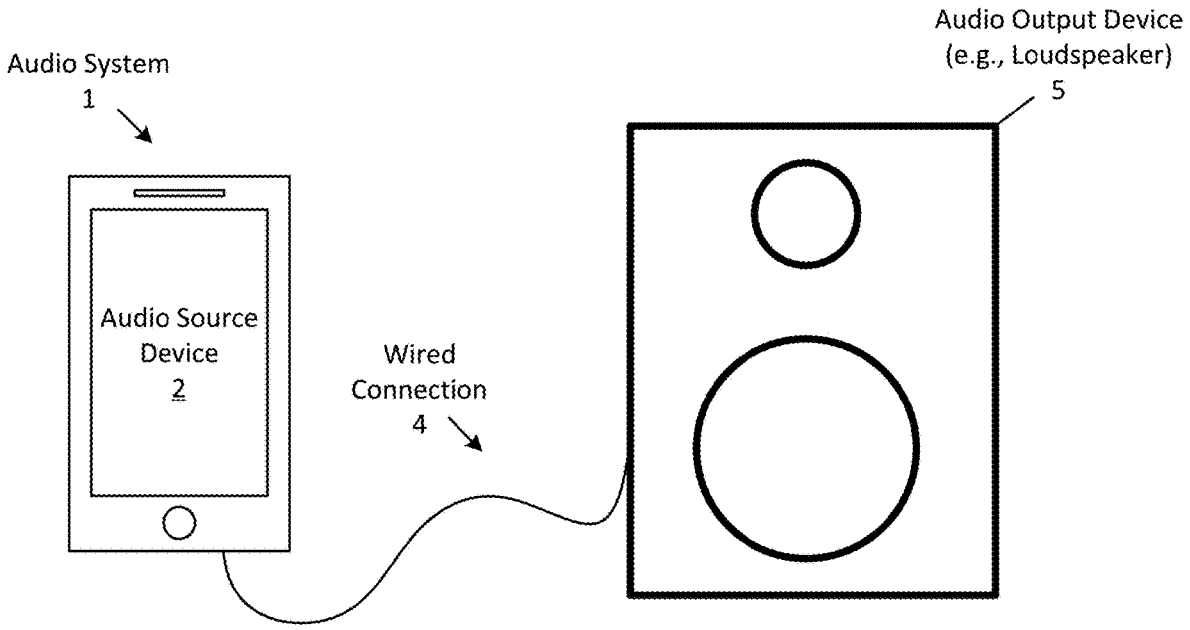
FIG. 1B shows an audio system that includes the audio source device and a loudspeaker.

FIG. 1B shows the audio system 1 that includes the audio source device 2 and an audio output device 5. As illustrated, the audio output device is a loudspeaker 5, which is arranged to direct sound into the (ambient) environment. In one aspect, the audio output device may be any electronic device that is arranged to output sound into the environment. For instance, the output device 5 may be part of a stand-alone speaker, a smart speaker, a home theater system, or an infotainment system that is integrated within a vehicle. As an example, the output device 5 may be at least one loudspeaker that is a part of an audio system, such as the home theater system or infotainment system, as described herein. In one aspect, the output device 5 may include one speaker or more than one speaker. Similar to FIG. 1A, the audio source device and the audio output device 5 are shown as being communicatively coupled via a wired connection 4, which may be an analog or digital connection, as described herein.

In one aspect, the audio source device 2 may be communicatively coupled with either audio output device 3 and 5 via a wireless connection instead (or in addition to) the wired connection 4. Specifically, in FIG. 1A the audio source device 2 may pair with the audio output device 3 via a wireless connection to form the audio system that is configured to output sound. For instance, the source device may be configured to establish a wireless connection with the output device via a wireless communication link (e.g., via BLUETOOTH protocol or any other wireless communication protocol). During the established wireless communication link, the source device may exchange (e.g., transmit and receive) data packets (e.g., Internet Protocol (IP) packets) with the output device. More about establishing a wireless communication link and exchanging data is described herein.

In one aspect, an audio source device (such as device 2) may be able to identify an audio output device with which it is paired (e.g., communicatively coupled). For instance, once both devices are paired, the output device may transmit device data to the audio source device that contains identification information, such as the type of electronic device. In some instances, however, the audio output device may be unable to transmit the information or may not include the capabilities (or electrical components, such as memory, one or more processors, etc.) to transmit such information. For example, the loudspeaker 5 may be unable to transmit any information since the wired analog connection 4 may only be arranged to pass through (e.g., for the loudspeaker to receive and/or transmit) analog audio signals. As another example, the output device may include the (e.g., communication) capabilities to transmit such information, but may be unable to transmit for various reasons (e.g., such information may be inaccessible by the device). To overcome these deficiencies, the present disclosure provides an audio system that is capable of determining the type of audio output device that is a part of the audio system (e.g., whether the device is a headset or a loudspeaker). More about how this determination is made is described herein.

Figure 2:
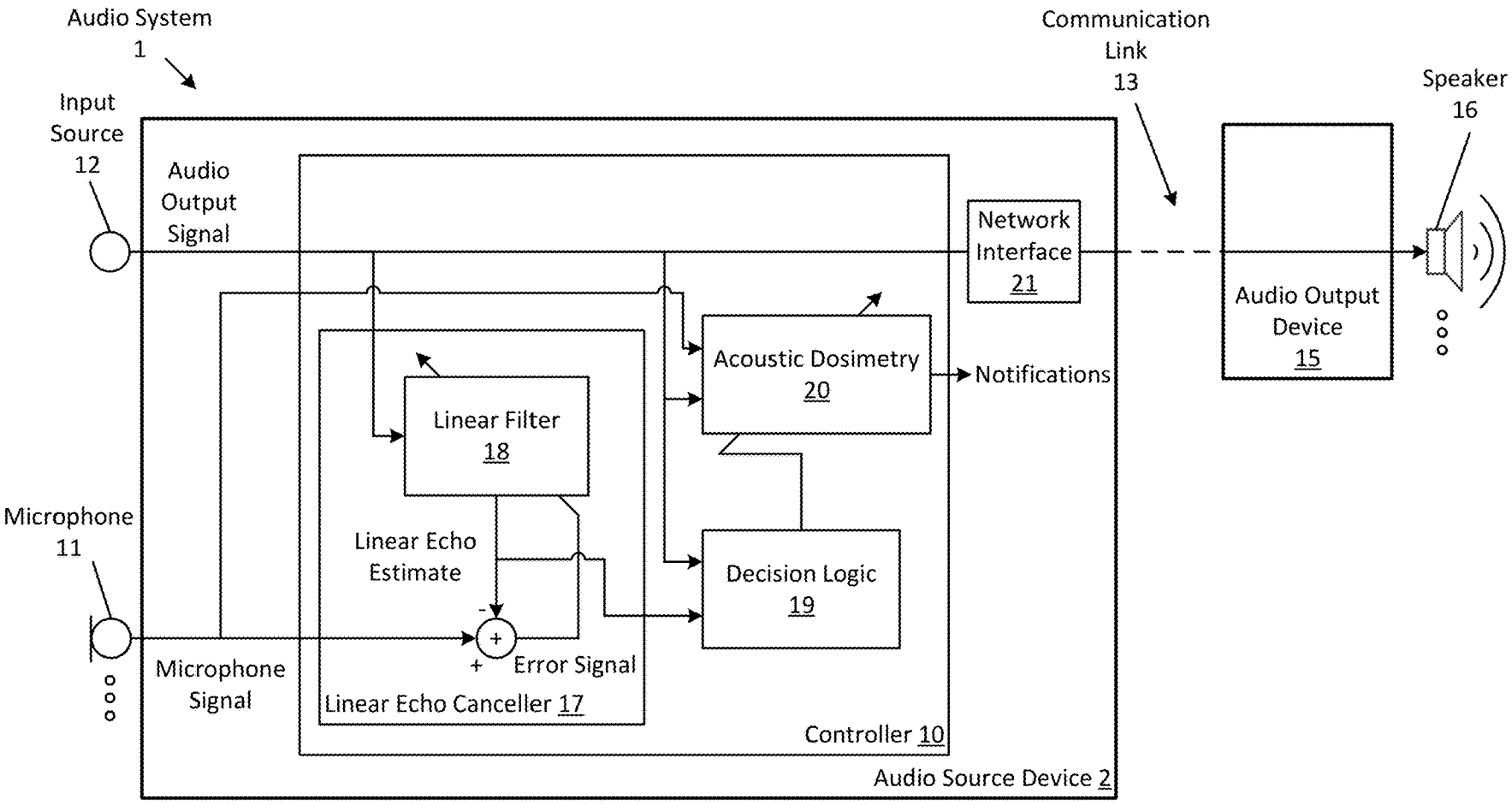
FIG. 2 shows a block diagram of an audio system that configures the audio source device based on a type of audio output device.

FIG. 2 shows a block diagram of an audio system 1 that configures the audio source device 2 based on whether an audio output device 15 is a headset or loudspeaker. The audio source device includes one or more microphones 11, an input source 12, a controller 10, and a network interface 21. In one aspect, the audio source device may include more or less elements (or components) as described herein. For instance, the audio source device may include at least one display screen that is configured to display image data and may include one or more speakers.

The microphone 11 may be any type of microphone (e.g., a differential pressure gradient micro-electro-mechanical system (MEMS) microphone) that is configured to convert acoustical energy caused by sound wave propagating in an acoustic environment into a microphone signal. Microphone 11 may be an "external" (or reference) microphone that is configured to capture sound from the acoustic environment, which is in contrast to an "internal" (or error) microphone that is configured to capture sound (and/or sense pressure changes) inside a user's ear (or ear canal).

The input source 12 may include a programmed processor that is running a media player application program and may include a decoder that is producing an audio output signal as digital audio input to the controller 10. In one aspect, the programmed processor may be a part of the audio source device 2, such that the media player application program is executed within the device. In another aspect, the application program may be executed upon another electronic device that is paired with the audio source device. In this case, the electronic device executing the program may (e.g., wirelessly) transmit the audio output signal to the audio source device. In some aspects, the decoder may be capable of decoding an encoded audio signal, which has been encoded using any suitable audio codec, such as, e.g., Advanced Audio Coding (AAC), MPEG Audio Layer II, MPEG Audio Layer III, or Free Lossless Audio Codec (FLAC).

Alternatively, the input audio source 12 may include a codec that is converting an analog or optical audio signal, from a line input, for example, into digital form for the controller. Alternatively, there may be more than one input audio channel, such as a two-channel input, namely left and right channels of a stereophonic recording of a musical work, or there may be more than two input audio channels, such as for example the entire audio soundtrack in 5.1-surround format of a motion picture film or movie. In one aspect, the input source 12 may provide a digital input or an analog input.

The controller 10 may be a special-purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines). The controller is configured to perform acoustic dosimetry process operations, echo cancellation operations, and networking operations. For instance, the controller 10 is configured to obtain an audio output signal from the input source 12, determine whether an audio output device with which the audio source device is communicatively coupled (or paired) is a headset or a loudspeaker, and configure the dosimetry process based on the determination. More about the operations performed by the controller is described herein. In one aspect, operations performed by the controller 10 may be implemented in software (e.g., as instructions stored in memory of the audio source device 2 and executed by the controller 10) and/or may be implemented by hardware logic structures as described herein.

The audio output device 15 includes at least one speaker 16. For instance, as described herein, the audio output device may be a headset (e.g., headset 3, in FIG. 1A), or a loudspeaker (e.g., loudspeaker 5, in FIG. 1B). In one aspect, the audio output device 15 may include more or less elements. For example, the device 15 may include one or more processors that may be configured to perform audio signal processing operations, may include one or more (internal or external) microphones, and may include a network interface. As another example, the output device may only include one speaker. In one aspect, one or more of the speakers 16 may be an electrodynamic driver that may be specifically designed for sound output at certain frequency bands, such as a woofer, tweeter, or midrange driver, for example. In one aspect, the speaker 16 may be a "full-range" (or "full-band") electrodynamic driver that reproduces as much of an audible frequency range as possible.

As described herein, the audio source device 2 may be paired with the audio output device 15 in order to exchange data. For example, the audio source device 2 may be a wireless electronic device that is configured to establish a (wireless) communication data link 13 (or wireless connection) via the network interface 21 with another electronic device (such as output device 15) over a wireless computer network (e.g., a wireless personal area network (WPAN)) using e.g., BLUETOOTH protocol or a WLAN in order to exchange data. In one aspect, the network interface 21 is configured to establish the wireless communication data link 13 with a wireless access point in order to exchange data with a remote electronic server (e.g., over the internet). In another aspect and as described herein, the communication link 13 may be a wired connection (e.g., via a wire that couples both devices together). While both devices are paired, the audio source device is configured to transmit, via an established communication link 13, the audio output signal to the audio output device 15. The audio output device 15 drives the one or more speakers 16 with the output signal in order to playback sound. Thus, the audio output device may stream and output audio signals from the source device, which may contain user-desired content, such as music.

As illustrated, the controller 10 may have one or more operational blocks, which may include a linear echo canceller (or canceller) 17, decision logic 19, and an acoustic dosimetry 20. The linear echo canceller 17 is configured to reduce (or cancel) linear components of echo by estimating the echo from the audio output signal that the source device transmits to the output device 15 for playback. Specifically, the canceller performs an acoustic echo cancellation process upon a microphone signal using the audio output signal as a reference input, to produce the linear echo estimate that represents an estimate of how much of the audio output signal (outputted by the speaker 16) is in the microphone signal produced by the microphone 11. The canceller determines a linear filter 18 (e.g., a finite impulse response (FIR) filter), and applies the filter to the audio output signal to generate the estimate of the linear echo. In one aspect, the linear filter 18 is a default filter stored within memory of the (controller of the) source device 2. In another aspect, the filter is determined by measuring an impulse response at the microphone 11. For instance, the audio source device may drive the speaker 16 of the output device to output a sound. In response to the sound, the microphone produces a microphone signal, from which the impulse response is measured, which represents a transmission path between the speaker 16 and the microphone 11.

The canceller 17 obtains a microphone signal that is produced by the microphone 11. In one aspect, the microphone signal is produced in response to the speaker 16 of the audio output device 15 playing back the audio output signal. Thus, the microphone signal may contain sounds (e.g., echo) of the outputted sounds of the speaker 16, along with other sounds. The canceller 17 subtracts the linear echo estimate produced by the filter 18 from the microphone signal to produce an error signal in order to remove (all or at least some of) the echo. The canceller 17 uses the error signal to update the filter 18 so that the difference between the microphone signal and the error signal may be reduced.

The decision logic 18 is configured to obtain the linear echo estimate produced from the canceller 17 and the audio output signal from the input source 12, and configured to determine whether the audio output device 15 is a headset or loudspeaker. In particular, the decision logic determines the level of correlation between the linear echo estimate and the audio output signal. For instance, the decision logic determines whether there is sufficient correlation between the echo estimate and the microphone signal. In one aspect, there is sufficient correlation when a level of correlation between the estimate and the signal is above a threshold. If above the threshold, meaning that the microphone signal contains at least some of the audio output signal outputted by the speaker 16, the decision logic determines that the output device 15 is a loudspeaker. The level of correlation being above the threshold is a result of the sound being outputted into the ambient environment. If, however, the level of correlation is below the threshold, the decision logic determines that the output device is a headset, since this may mean that the output device is not outputting sound into the ambient environment. In one aspect, the thresholds may be different. For instance, the determination of whether the output device is a loudspeaker may be based on the level of correlation being above a first threshold, while the determination of whether the output device is a headset may be based on the level of correlation being below a second threshold that is below the first threshold.

The acoustic dosimetry 20 is configured to obtain a signal from the decision logic 19 that indicates the type of audio output device 15 that is paired with the audio source device, and is configured to perform an acoustic dosimetry process based on the signal. Specifically, upon receiving an indication that the audio output device is a headset, the acoustic dosimetry process is configured to make sound level measurements associated with headset use, and is configured to output notifications associated with the measurements. For instance, the dosimetry process may estimate in-ear sound pressure level, SPL, as follows. The acoustic dosimetry 20 may compute a measure of strength of the audio output signal that is being played back, for example as a root mean square, RMS value. Note that the output audio is a result of an audio rendering process that performs a conventional audio signal processing chain of operations upon an input playback signal (containing media such as music or a movie soundtrack.) These may include dynamic range adjustments, equalization, and gain adjustment for volume step. The process then converts the RMS value of such output audio into an in-ear SPL, by applying to the RMS value (multiplying it by) output sensitivity data (for the presently used headset). In one aspect, the output sensitivity data may be assigned data that may include headphone acoustic output sensitivity and volume curve parameters. This data may be stored within the audio source device 2. In another aspect, this data may be transmitted by the audio output device. In another aspect, this data may be generic or default data (e.g., not for any specific audio output device). As an example, dB Full scale RMS values are converted into in-ear SPL dB values.

In one aspect, the in-ear SPL may be determined by processing a microphone signal obtained from an internal microphone of the audio output device, as described herein. In another aspect, the in-ear SPL may be determined by processing at least one of an internal and an external microphone of the audio output device.

Next, the measure or estimate of in-ear SPL is converted to units of a hearing health safety standard for audio exposure (a standard or commonly defined metric for permissible audio exposure for hearing health.) For example, the in-ear SPL may be multiplied by a transfer function (that has been determined in a laboratory setting) which converts in-ear SPL to an equivalent, free-field or diffuse field measurement of sound as would be picked up by an imaginary reference microphone that is located at some distance away from the user, as defined by the hearing health safety standard. The result is referred to here as a computed sound sample, for example in units of SPL dBA (A-weighted decibels).

In one aspect, the sound sample may be computed repeatedly over time, for example every second or other suitable interval during playback. The sound samples may then be presented by an application program (also being executed by the controller 10 of the audio source device 2) for visualization on a graphical user interface of the audio source device (not shown). For example, a health application program may be given authorization to access the locally stored health database to retrieve the sound samples, and computes various statistical measures of the collected sound samples, such as Leq dBA (average) over certain time intervals. The health app may then "show" the user their audio exposure that is due to playback by the headset. The health app may also visualize to the user which portions of the sound samples were produced by which apps (e.g. a music app, a video game app, and a movie player), and which models of against the ear audio devices produced which sound samples. It is expected that the user may use several different models of headsets for listening, such as in-ear wired earbuds, in-ear wireless earbuds, and on-the-ear headphones, at different volume steps or with different media. This useful information may be monitored and reported to the user by the health app. Other ways of reporting useful information to the user about such collected sound samples (acoustic dosimetry) are possible. For instance, the data may be presented by another electronic device that is paired with the source device. As another example, the audio source device may output a haptic or audio alert indicating the audio exposure.

If, however, the acoustic dosimetry 20 receiving an indication from the decision logic 19 that the audio output device 15 is a loudspeaker, the acoustic dosimetry process is configured to make sound level measurements associated with ambient noise and is configured to output notifications associated with the measurements. For instance, to make the sound level measurements, the process obtains the microphone signal produced by the microphone 11 of the source device 2, and uses the signal to estimate the SPL of the ambient environment. In addition or as an alternative, the acoustic dosimetry may obtain a microphone signal from one or more electronic devices (e.g., a wearable device) that is paired with the source device 2. From the estimated SPL, the acoustic dosimetry 20 may output alerts or notifications associated with ambient sound levels, such as a current SPL, as described herein.

Figure 3:
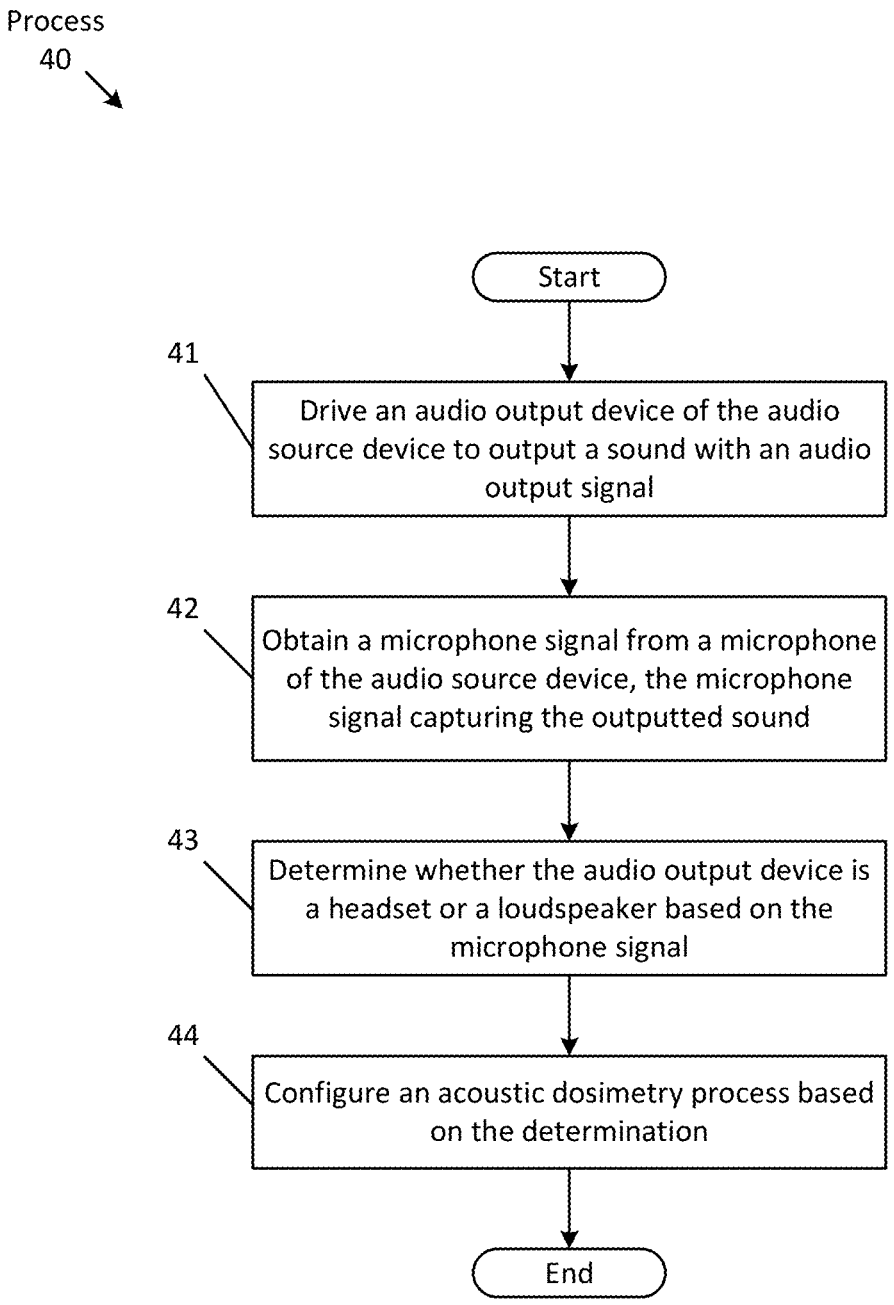
FIG. 3 is a flowchart of one aspect of a process to configure an audio source device based on a type of audio output device.

FIG. 3 is a flowchart of one aspect of a process to configure an audio source device based on whether an audio output device is a headset or loudspeaker. In one aspect, the process 40 is performed by (e.g., the controller 10 of) the audio source device 2 and/or by the audio output device 15. Thus, this figure will be described with reference to FIG. 2. The process 40 begins by the controller 10 driving an audio output device of the audio source device to output a sound with an audio signal (at block 41). Specifically, the controller 10 of the audio source device may signal the network interface 21 that the audio output signal be transmitted to the output device 15 for playback. Once signaled, the audio output signal is transmitted (via the communication link 13) to the audio output device 15, which uses the signal to drive the speaker 16 to output sound contained within the signal. In another aspect, when the audio output device 15 includes multiple speakers (e.g., in the case of a headset with a left speaker and a right speaker), the source device 2 may transmit multiple audio output signals (e.g., a left audio channel and a right audio channel).

The controller 10 obtains a microphone signal from a microphone 11 of the audio source device 2, the microphone signal capturing the outputted sound (at block 42). Specifically, the microphone 11 may sense the outputted sound and, in response, produce a microphone signal that contains the outputted sound and/or ambient noise within the ambient environment. The controller 10 determines whether the audio output device is a headset or a loudspeaker based on the microphone signal (at block 43). Specifically, the (linear echo canceller 18 of the) controller 10 may process the microphone signal by performing, using the audio output signal as a reference input, an acoustic echo cancellation process upon the microphone signal to produce a linear echo estimate. The decision logic 19 determines whether the audio output device is a headset or a loudspeaker based on a level of correlation between the audio output signal that is driving the audio output device and the linear echo estimate. The controller 10 configures the acoustic dosimetry process based on the determination (at block 44). For instance, the controller 10 may determine the in-ear SPL when the audio output device is a headset in order to monitor sound samples, as described herein.

Some aspects may perform variations to the processes described herein. For example, the specific operations of at least some of the processes may not be performed in the exact order shown and described. The specific operations may not be performed in one continuous series of operations and different specific operations may be performed in different aspects. For example, once the acoustic dosimetry process is configured, the audio source device capture and store one or more sound samples to produce cumulative data over time (e.g., a day, etc.). In one aspect, from the cumulative data, the source device may output notifications (or alerts), indicating an audio exposure reading to the user of the source device.

As described herein, one aspect of the present technology is the gathering and use of data available from specific and legitimate sources to improve health and safety of a user's hearing. The present disclosure contemplates that in some instances, this gathered data may include personal information data that uniquely identifies or can be used to identify a specific person. Such personal information data can include demographic data, location-based data, online identifiers, telephone numbers, email addresses, home addresses, data or records relating to a user's health or level of fitness (e.g., vital signs measurements, medication information, exercise information, SPL measurements), date of birth, or any other personal information.

The present disclosure recognizes that the use of such personal information data, in the present technology, can be used to the benefit of users. For example, the health and fitness data can be used to measure a user's audio exposure and to provide a cumulative audio exposure reading in accordance with user preferences. Accordingly, use of such personal information data enables users to have perform better listening habits.

The present disclosure contemplates that those entities responsible for the collection, analysis, disclosure, transfer, storage, or other use of such personal information data will comply with well-established privacy policies and/or privacy practices. In particular, such entities would be expected to implement and consistently apply privacy practices that are generally recognized as meeting or exceeding industry or governmental requirements for maintaining the privacy of users. Such information regarding the use of personal data should be prominent and easily accessible by users, and should be updated as the collection and/or use of data changes. Personal information from users should be collected for legitimate uses only. Further, such collection/sharing should occur only after receiving the consent of the users or other legitimate basis specified in applicable law. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations that may serve to impose a higher standard. For instance, in the US, collection of or access to certain health data may be governed by federal and/or state laws, such as the Health Insurance Portability and Accountability Act (HIPAA); whereas health data in other countries may be subject to other regulations and policies and should be handled accordingly.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, such as in the case of advertisement delivery services, the present technology can be configured to allow users to select to "opt in" or "opt out" of participation in the collection of personal information data during registration for services or anytime thereafter. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing identifiers, controlling the amount or specificity of data stored (e.g., collecting location data at city level rather than at an address level), controlling how data is stored (e.g., aggregating data across users), and/or other methods such as differential privacy.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users based on aggregated non-personal information data or a bare minimum amount of personal information, such as the content being handled only on the user's device or other non-personal information available to the content delivery services As previously explained, an aspect of the disclosure may be a non-transitory machine-readable medium (such as microelectronic memory) having stored thereon instructions, which program one or more data processing components (generically referred to here as a "processor") to perform the network operations, signal processing operations, audio signal processing operations, and acoustic dosimetry operations. In other aspects, some of these operations might be performed by specific hardware components that contain hardwired logic. Those operations might alternatively be performed by any combination of programmed data processing components and fixed hardwired circuit components.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting.

In some aspects, this disclosure may include the language, for example, "at least one of [element A] and [element B]." This language may refer to one or more of the elements. For example, "at least one of A and B" may refer to "A," "B," or "A and B." Specifically, "at least one of A and B" may refer to "at least one of A and at least one of B," or "at least of either A or B." In some aspects, this disclosure may include the language, for example, "[element A], [element B], and/or [element C]." This language may refer to either of the elements or any combination thereof. For instance, "A, B, and/or C" may refer to "A," "B," "C," "A and B," "A and C," "B and C," or "A, B, and C."

What is claimed is:

1. A method performed by a processor of an audio source device, the method comprising:

driving an audio output device of the audio source device to output a sound with an audio output signal;

obtaining a microphone signal from a microphone of the audio source device, the microphone signal capturing the sound output;

determining whether the audio output device is a headset or a loudspeaker based on the microphone signal;

responsive to determining that the audio output device is a headset, configuring an acoustic dosimetry process for the headset; and responsive to determining that the audio output device is a loudspeaker, configuring an acoustic dosimetry process for the loudspeaker.

2. The method of claim 1, wherein determining comprises performing, using the audio output signal as a reference input, an acoustic echo cancellation process upon the microphone signal to produce a linear echo estimate; and determining a level of correlation between the audio output signal and the linear echo estimate.

3. The method of claim 2, wherein when the level of correlation is above a threshold the audio output device is determined to be the loudspeaker, and when the level of correlation is below the threshold the audio output device is determined to be the headset.

4. The method of claim 1, wherein the audio source device is communicatively coupled to the audio output device via a wired connection.

5. The method of claim 1, wherein the loudspeaker is a part of a smart speaker.

6. The method of claim 1, wherein upon determining that the audio output device is the headset, the acoustic dosimetry process for the headset is configured to make sound level measurements associated with sounds picked up in an ear canal of a user who is wearing the headset.

7. The method of claim 1, wherein upon determining that the audio output device is the loudspeaker, the acoustic dosimetry process for the loudspeaker is configured to make sound level measurements associated with ambient noise.

8. An audio source device, comprising:

a microphone;

a processor; and a memory having stored therein instructions which when executed by the processor cause the audio source device to drive an audio output device to output a sound with an audio output signal;

obtain a microphone signal from the microphone, the microphone signal capturing the sound output;

determine whether the audio output device is a headset or a loudspeaker based on the microphone signal;

responsive to determining that the audio output device is a headset, configure an acoustic dosimetry process for the headset; and responsive to determining that the audio output device is a loudspeaker, configure an acoustic dosimetry process for the loudspeaker.

9. The audio source device of claim 8, wherein the instructions to determine whether the audio output device is a headset or a loudspeaker comprises instructions to perform, using the audio output signal as a reference input, an acoustic echo cancellation process upon the microphone signal to produce a linear echo estimate; and determine a level of correlation between the audio output signal and the linear echo estimate.

10. The audio source device of claim 9, wherein when the level of correlation is above a threshold the audio output device is determined to be the loudspeaker, and when the level of correlation is below the threshold the audio output device is determined to be the headset.

11. The audio source device of claim 8, wherein the audio source device is communicatively coupled to the audio output device via a wired connection.

12. The audio source device of claim 8, wherein the loudspeaker is a part of a smart speaker.

13. The audio source device of claim 8, wherein upon determining that the audio output device is the headset, the acoustic dosimetry process for the headset is configured to make sound level measurements associated with sounds picked up in an ear canal of a user who is wearing the headset.

14. The audio source device of claim 8, wherein upon determining that the audio output device is the loudspeaker, the acoustic dosimetry process for the loudspeaker is configured to make sound level measurements associated with ambient noise.

15. A processor of an audio source device that is configured to:

drive an audio output device of the audio source device to output a sound with an audio output signal;

obtain a microphone signal from a microphone of the audio source device, the microphone signal capturing the sound output;

determine whether the audio output device is a headset or a loudspeaker based on the microphone signal;

responsive to determining that the audio output device is a headset, configure an acoustic dosimetry process for the headset; and responsive to determining that the audio output device is a loudspeaker, configure an acoustic dosimetry process for the loudspeaker.

16. The processor of claim 15, wherein the instructions to determine whether the audio output device is a headset or a loudspeaker comprises instructions to perform, using the audio output signal as a reference input, an acoustic echo cancellation process upon the microphone signal to produce a linear echo estimate; and determine a level of correlation between the audio output signal and the linear echo estimate.

17. The processor of claim 16, wherein when the level of correlation is above a threshold the audio output device is determined to be the loudspeaker, and when the level of correlation is below the threshold the audio output device is determined to be the headset.

18. The processor of claim 15, wherein the audio source device is communicatively coupled to the audio output device via a wired connection.

19. The processor of claim 15, wherein the loudspeaker is a part of a smart speaker.

20. The processor of claim 15, wherein upon determining that the audio output device is the headset, the acoustic dosimetry process for the headset is configured to make sound level measurements associated with sounds picked up in an ear canal of a user who is wearing the headset.

21. The processor of claim 15, wherein upon determining that the audio output device is the loudspeaker, the acoustic dosimetry process for the loudspeaker is configured to make sound level measurements associated with ambient noise.

* * * * *